US009302843B2

(12) United States Patent
Yamada

(10) Patent No.: US 9,302,843 B2
(45) Date of Patent: Apr. 5, 2016

(54) WEB CONTAINER

(71) Applicant: Kikuo Yamada, Tokyo (JP)

(72) Inventor: Kikuo Yamada, Tokyo (JP)

(73) Assignee: Kikuo Yamada, Tokyo (JP)

( * ) Notice: Subject to any disclaimer, the term of this patent is extended or adjusted under 35 U.S.C. 154(b) by 44 days.

(21) Appl. No.: 14/166,746

(22) Filed: Jan. 28, 2014

(65) Prior Publication Data

US 2014/0262908 A1 Sep. 18, 2014

Related U.S. Application Data

(63) Continuation of application No. PCT/JP2013/056963, filed on Mar. 13, 2013.

(51) Int. Cl.
*B65D 73/00* (2006.01)
*B65D 83/08* (2006.01)
*B65D 77/06* (2006.01)

(52) U.S. Cl.
CPC ..... *B65D 83/0805* (2013.01); *B65D 77/06* (2013.01)

(58) Field of Classification Search
CPC ..... B65D 73/00; B65D 33/16; B65D 71/00; B65D 83/08
USPC ..... 206/494, 812, 233, 459.5, 440, 207, 206/210, 775–781; 220/62.14; 221/33, 45, 221/46, 49, 64, 65
See application file for complete search history.

(56) References Cited

U.S. PATENT DOCUMENTS 6,213,300 B1 * 4/2001 Flaig et al. ..... 206/494
7,172,093 B2 * 2/2007 Bando ..... 221/63
2006/0283752 A1 * 12/2006 Alegre de Miquel ..... 206/494
2007/0284266 A1 * 12/2007 McDonald et al. ..... 206/233
2010/0300915 A1 * 12/2010 Kakura et al. ..... 206/494
2011/0011767 A1 * 1/2011 Gehring et al. ..... 206/581

FOREIGN PATENT DOCUMENTS

JP 02-099792 U 8/1990
JP 3029550 U 1/1996
JP 3029550 U 10/1996
JP 09-086584 3/1997
JP 09-132280 5/1997

(Continued)

OTHER PUBLICATIONS

Written Opinion for corresponding International Application No. PCT/JP2013/056963, Jun. 25, 2013.
International Search Report for corresponding International Application No. PCT/JP2013/056963, Jun. 25, 2013.

(Continued)

*Primary Examiner* — Jacob K Ackun
*Assistant Examiner* — Rafael Ortiz
(74) *Attorney, Agent, or Firm* — Mori & Ward, LLP

(57) ABSTRACT

A web container includes a web storage, a transparent plastic cover, and an intermediate layer. The web storage includes a bag which stores a foldable web and which has a first opening through which the foldable web is to be taken out. The web storage includes a take-out port which is coupled to the first opening. The transparent plastic cover has a polyhedron shape to enclose the web storage. The transparent plastic cover has a second opening provided on one surface of the transparent plastic cover. The second opening is engaged with the take-out port. The intermediate layer includes a flat sheet provided between the cover and the web storage and over at least two adjacent surfaces of the transparent plastic cover.

6 Claims, 8 Drawing Sheets

(56) References Cited

FOREIGN PATENT DOCUMENTS

| | | |
|---|---|---|
| JP | 2001-046275 | 2/2001 |
| JP | 3138354 U | 12/2007 |
| JP | 2009-132432 | 6/2009 |
| JP | 2011-168341 | 9/2011 |
| WO | WO 2012/070230 | 5/2012 |

OTHER PUBLICATIONS

International Preliminary Report on Patentability with Written Opinion of the International Searching Authority for corresponding International Application No. PCT/JP2013/056963, Jun. 25, 2013.

Japanese Office Action for corresponding JP Application No. 2014-546640, May 12, 2015.

* cited by examiner

WEB CONTAINER

CROSS-REFERENCE TO RELATED APPLICATIONS

The present application is a continuation application of International Application No. PCT/JP2013/056963, filed Mar. 13, 2013. The contents of this application are incorporated herein by reference in their entirety.

BACKGROUND OF THE INVENTION

1. Field of the Invention

The present invention relates to a web container.

2. Discussion of the Background

Tissue paper or wet tissues have widely been used for both domestic and business purposes, and the industrial fields of application have been extended. The tissue paper also merely refers to as "tissue", which is a poorly-water-soluble daily necessity made up of a thin, soft fiber sheet. The tissue paper abounds in flexibility and is made up of soft materials, so that the tissue paper has been used for various purposes. Generally, the tissue paper is made up of a set of two fiber sheets fitted together on their back surfaces, with their front surfaces exposed to the outside to provide a smooth touch on both front surfaces. Hereinafter, a set of two sheets of tissue paper will be regarded as one sheet of tissue paper. The wet tissue is made up of fiber sheets such as a non-woven fabric impregnated with an impregnant such as agents and cosmetic material. The wet tissue is used for removing stains on hands, disinfection, cleaning a baby's bottoms, and other purposes. Hereinafter, fiber sheets such as the tissue paper and the wet tissue will be collectively referred to as "web".

Conventionally, the tissue paper or the wet tissue is folded and stored in a bag formed of a soft film and designed to be taken out one by one through an opening formed on the bag, which makes the tissue paper or the wet tissue easy to use. Even though the bag is easy to carry about, the bag is easily deformed and lacks stability in that when the bag is placed on a desk, the bottom surface of the bag may not be flat, and the external appearance the bag may not be favorable. Thus, it may not be suitable to use the bag on a desk in a room.

In order to provide stability for desktop applications and a favorable appearance, it is common practice to use a web storage, which is a bag that includes webs, and place the web storage in a container. The container is generally fabricated in a not easily deformed manner (see, for example, JP2011-168341A).

SUMMARY OF THE INVENTION

According to one aspect of the present invention, a web container includes a web storage, a transparent plastic cover, and an intermediate layer. The web storage includes a bag which stores a foldable web and has a first opening through which the foldable web is to be taken out. The web storage includes a take-out port which is coupled to the first opening. The transparent plastic cover has a polyhedron shape to enclose the web storage. The transparent plastic cover has a second opening provided on one surface of the transparent plastic cover. The second opening is engaged with the take-out port. The intermediate layer includes a flat sheet provided between the cover and the web storage and over at least two adjacent surfaces of the transparent plastic cover.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4A illustrates a state in which a lid is closed, and FIG. 4B illustrates a state in which the lid is open;

FIG. 8A illustrates a reflection state of light in a case where the web container of an embodiment is exposed to the light, and FIG. 8B illustrates a reflection state of light in a case where a conventional web container is exposed to the light.

DESCRIPTION OF THE EMBODIMENTS

Figure 1:
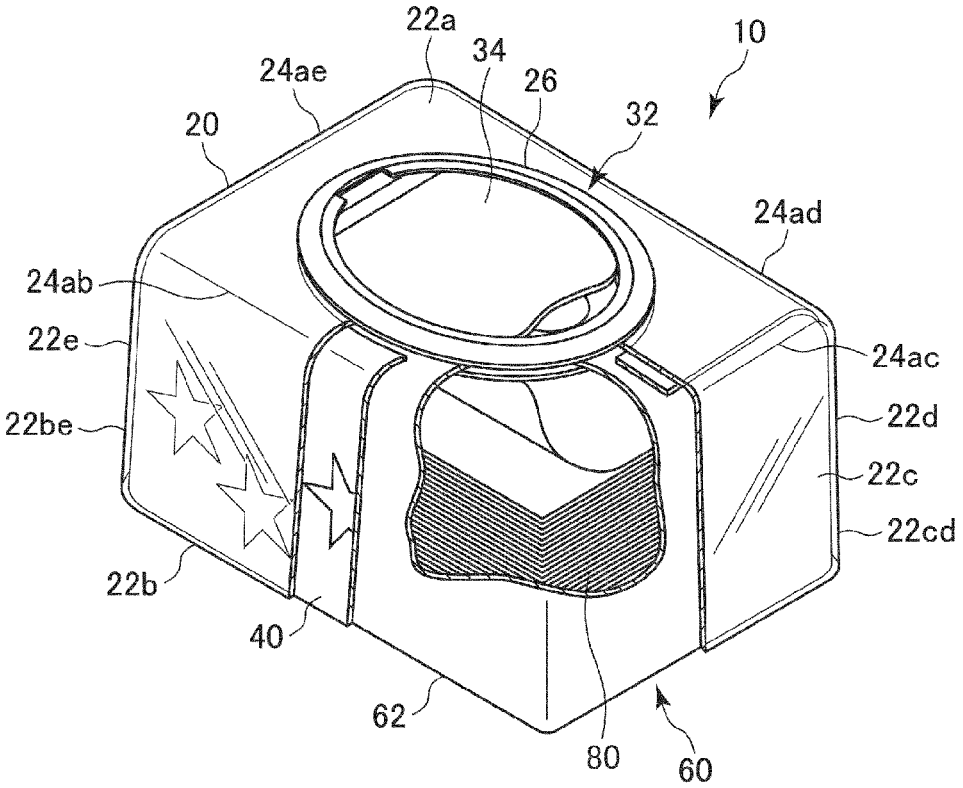
FIG. 1 is a perspective view of a web container, illustrating a configuration of the web container, where the view is partially cut out to make the interior of the web container visible.

The embodiments will now be described with reference to the accompanying drawings, wherein like reference numerals designate corresponding or identical elements throughout the various drawings.

FIG. 1 is a configuration perspective view of a web container 10. The configuration perspective view is partially cut out to make the interior of the web container 10 visible. Star symbols are designed on an intermediate layer 40 and visible through a cover 20.

The web container 10 includes a web storage 60 in the interior of the cover 20. That is, the cover 20 surrounds the web storage 60. It is noted that the embodiment of the cover 20 surrounding the web storage 60 encompasses those cases where the cover 20 does not completely cover all the directions of the web storage 60. The intermediate layer 40 is disposed in the inner side of the cover 20. A coupling member 32 is fixed with the opening 26 of the cover 20. The web storage 60 includes a multitude of webs 80 folded in a bag 62. Another possible example of the webs 80 is that one continuous long sheet is folded or rolled into a layer form, and then divided apart at dividing portions provided at regular intervals on the sheet, resulting in the separate webs 80. Further, in order to prevent the web storage 60 stored from jumping out of the cover 20, it is possible to provide a bottom lid (not shown) on the bottom surface (lower surface in FIG. 1) of the web container 10. The bottom lid may be a tape seal or other material.

Figure 2:
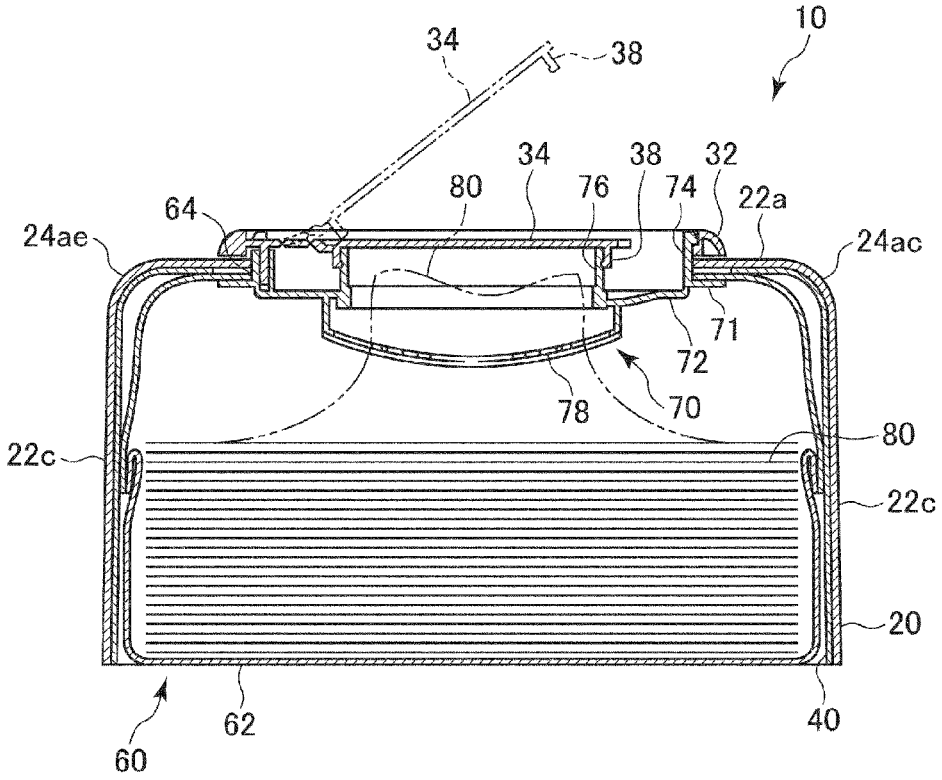
FIG. 2 is a cross-sectional view of another web container having a configuration is different from the configuration of the web container shown in FIG. 1.

FIG. 2 is a cross-sectional view of the web container 10. The dashed line shown in FIG. 2 illustrates a state in which a lid 34 is open. The lid 34 is openable and closable. The web container 10 in FIG. 2 is different from the web container 10 in FIG. 1 in that the intermediate layer 40 is disposed on the inner side of side surfaces 22*c* and 22*e* of the cover 20 and in that edge lines 24*ac* and 24*ae* are smooth.

Figure 3:
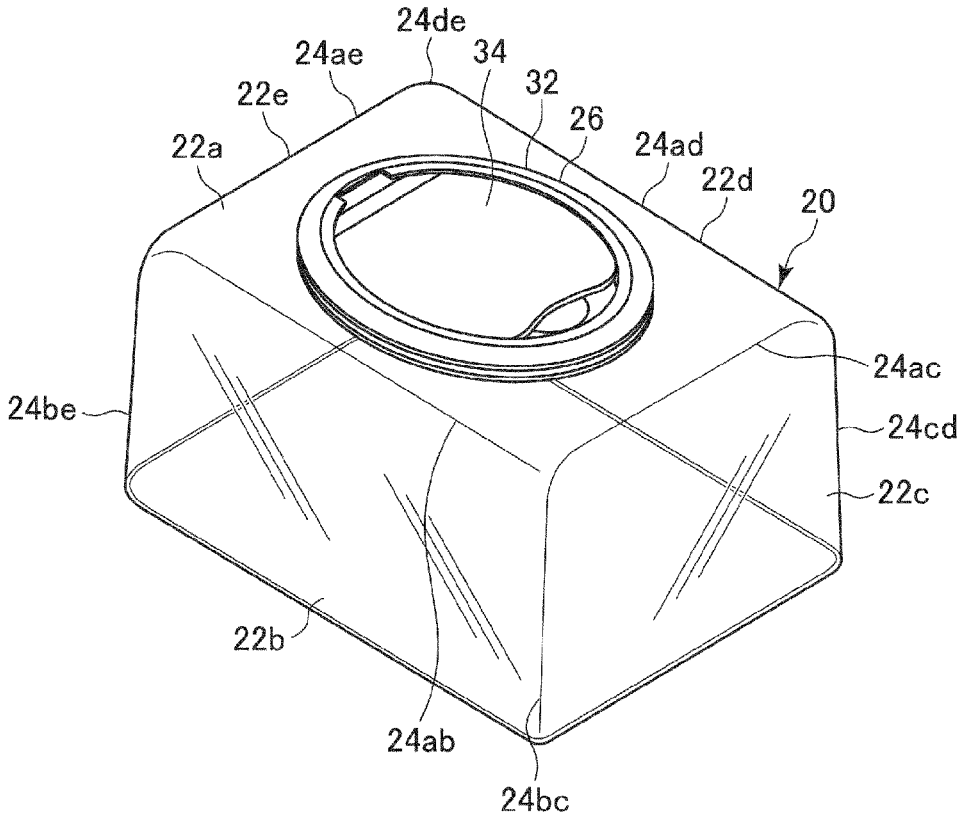
FIG. 3 is a perspective view of a cover.

The cover 20 will be described by referring to FIG. 3. FIG. 3 is a perspective view of the cover 20. FIG. 3 illustrates a state in which the coupling member 32 and the lid 34 are fixed on the cover 20. The cover 20 is made up of a transparent plastic material such as polyethylene terephthalate (PET), polycarbonate (PC), polypropylene (PP), and polystyrene (PS). The transparent plastic material is only required to provide a view of the interior through the cover 20, and thus encompasses translucent plastic materials, even though the interior may be visible less clearly.

The cover 20 has an approximately rectangular parallelepiped shape. The cover 20 includes an upper surface 22*a* illustrated at an upper portion in FIG. 3 and four side surfaces 22*b*, 22*c*, 22*d*, and 22*e*, which are adjacent to the upper surface 22*a*. The cover 20 is left open, that is, no surface is formed, at the side opposite to the upper surface 22*a* at a lower portion in FIG. 3. Edge lines 24*ab*, 24*ac*, 24*ad* and 24*ae* are respectively defined between the upper surface 22*a* and four side surfaces 22*b*, 22*c*, 22*d*, and 22*e*, and edge lines 24*bc*, 24*cd*, 24*de*, and 24*be* are respectively defined between the four side surfaces 22*b*, 22*c*, 22*d*, and 22*e*. Each of these edge lines is a smooth edge line without a sharp portion or a rough portion. As used herein, the term "smooth" generally means being round, without a sharp portion or a rough portion, and with a radius of curvature approximately ranging from 1 mm to 50 mm, preferably from 2 mm to 20 mm. With an excessively small radius of curvature, the intermediate layer 40 may be difficult to arrange along the cover 20 and easily take on creases. With an excessively large radius of curvature, it may be difficult for the cover 20 to store the web storage 60. It is noted that the smoothness encompasses an easement curve shape, which has an incremental radius of curvature at portions of contact with the adjacent surfaces across the edge line. In this case, the minimum radius of curvature preferably falls within the above-described range. The four side surfaces 22*b*, 22*c*, 22*d*, and 22*e* are gradually inclined outward as each side surface is distanced away from the upper surface 22*a*. Thus, the approximately rectangular parallelepiped shape includes such a shape that the cover 20 lacks one surface. The approximately rectangular parallelepiped shape also includes such a shape that the edge lines defined between the surfaces are smooth. The approximately rectangular parallelepiped shape also includes such a shape that adjacent surfaces are not orthogonal to each other. The surfaces may have an opening or openings other than the opening 26 formed on top. An opening (not shown) through which the intermediate layer 40 and the web storage 60 are inserted may be formed on any of the side surfaces of the cover 20, instead of on the bottom surface.

Figure 4A:
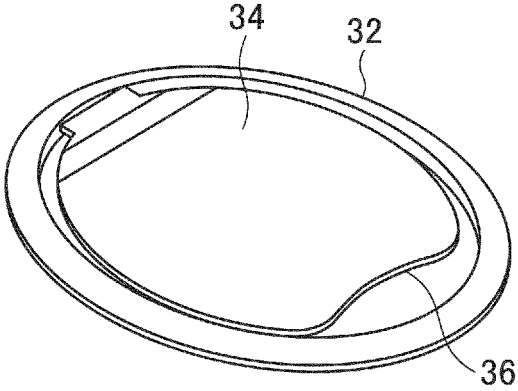
FIGS. 4A and 4B are perspective views of a coupling member, where
Figure 4B:
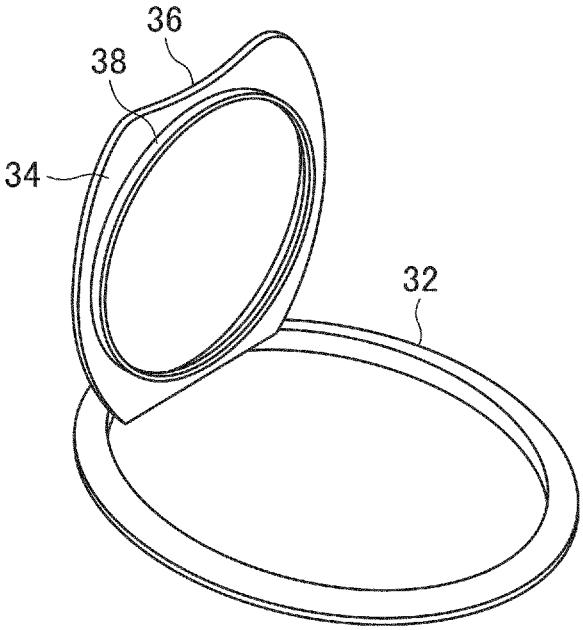

As shown in FIG. 1, the lid 34 is disposed on the upper surface of the web container 10 and used to take out the webs. FIGS. 4A and 4B are perspective views of the lid 34 integrally formed with the coupling member 32. FIG. 4A illustrates a state in which the lid 34 is closed. FIG. 4B illustrates a state in which the lid 34 is open.

The coupling member 32 is a member that couples a take-out port 70 and supports the cover 20, thereby fixing the cover 20. As described later, the coupling member 32 couples the take-out port 70 of the web storage 60 in such a manner that the cover 20 intervenes between the coupling member 32 and the take-out port 70, whereby holding a state in which the web storage 60 is suspended on the opening 26 of the cover 20.

When the lid 34 is opened and closed, a large amount of force is applied to the coupling member 32. Accordingly, it is necessary to enhance the rigidity of the coupling member 32. Also, elastic deformability is necessary for the joint between the coupling member 32 and the lid 34. In view of this, a relatively thick wall of plastic material such as polyethylene (PE) and polypropylene (PP) is used.

Next, the web storage 60 will be described by referring to FIG. 2. In the web storage 60, the bag 62 made of a soft film stores the folded webs 80. The webs 80 are sheet-shaped and made of a fiber such as non-woven fabric. Representative examples of the webs 80 include, but are not limited to, tissue paper and wet tissue.

Since the webs 80 folded and stored in the web storage 60 are square, the web storage 60 generally has a rectangular parallelepiped shape. In many cases, however, for the convenience of fabrication of the bag 62, projections used for pressure bonding purposes are formed on both sides of the bag 62. This, however, should not be construed as limiting the bag 62, and any other structure is possible.

The bag 62 includes an opening 64 through which the webs 80 are taken out of the bag 62. The take-out port 70 is disposed on the opening 64 at the web storage 60.

The take-out port 70 has an outer circumference 71 closely coupled to the bag 62 on the periphery of the opening 64. The outer circumference 71 may be adhered or welded to the bag 62. Any other method is possible insofar as the take-out port 70 is coupled to the opening 64 of the bag 62. While in FIG. 2 the bag 62 is adhered to the upper surface of the outer circumference 71 of the take-out port 70, the bag 62 may also be adhered to the lower surface of the outer circumference 71.

The center portion of the take-out port 70 serves as a path through which the webs 80 are taken out. At a lowermost portion of the take-out port 70, a resistance applying plate 78 is disposed. The resistance applying plate 78 is provided with a small hole through which to apply resistance so as to prevent a plurality of webs 80 from being coupled together and taken out at a time. The upper portion of the resistance applying plate 78 is an area of space where the tip of a raised web 80 is stored. The tip of the raised web 80 is held in the small hole of the resistance applying plate 78, and thus the tip of the raised web 80 can easily be picked up next time the raised web 80 is taken out.

A tubular open-and-close receiving portion 76 is provided at a center uppermost portion of the take-out port 70, that is, an upper portion of the storage space of the tip of the web. On the outer circumference of the open-and-close receiving portion 76, a depressed groove is formed, and the depressed groove is engaged with a protruding rim of the closing member 38 of the lid 34. This engagement mechanism ensures sealing of the web container 10 after use, and reliably prevents the webs 80 from going dry. While in FIG. 4 the hinge of the lid 34 is integrally formed with the coupling member 32, the lid 34 may also be integrally formed with the later-described take-out port 70 or may be a totally independent component. The web storage 60 may also be sealed by another structure such as a sticky seal (resealable). Specifically, a seal (not shown) with a tab may be disposed between the open-and-close receiving portion 76 and the resistance applying plate 78 to seal the interior of the web storage 60 before the use of the web container 10. The seal is easily removed by pulling the tab at the time of use.

A protruding rim is formed on the outer edge 74 at the upper portion of the take-out port 70, and the protruding rim is engaged with a depressed groove formed on the inner circumference of the coupling member 32. Thus, the take-out port 70 is engaged with the coupling member 32 and holds the opening 26 of the cover 20 by catching the opening 26 between the coupling member 32 and the take-out port 70.

Thus, the web container 60 is suspended from the cover 20 via the take-out port 70. This ensures that even when the residual number of the webs 80 reduces with the bag 62 collapsed, the opening 64, through which the webs 80 in the bag 62 are taken out, is not detached from the opening 26 of the cover 20. Thus, the webs 80 are easily taken out through the opening 26 at all times. While in FIG. 2 there is a large gap between the take-out port 70 and the cover 20 for clarity of the drawing, no gap or a smaller gap may be provided.

The take-out port 70 is formed of plastic material such as polyethylene (PE) and polypropylene (PP). The configuration shown in FIG. 2 should not be construed as limiting the configuration of the take-out port 70, and any other configuration may also be possible. For example, the take-out port 70 may not be coupled with the coupling member 32; instead, the take-out port 70 may be engaged with the opening 26 of the cover 20 or adhered to the cover 20, and thus engaged with the opening 26 of the cover 20. The lid 34 may be coupled to the take-out port 70 via the joint of the lid 34.

Figure 5:
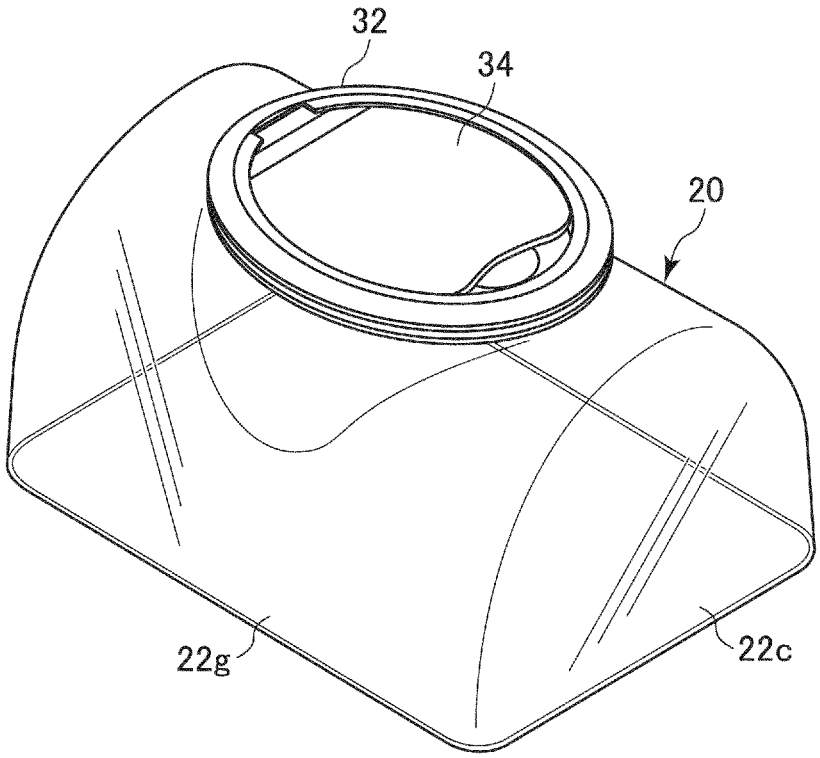
FIG. 5 is a perspective view of the cover according to a modification.

While in FIGS. 1 to 3 the cover 20 has been illustrated as having an approximately rectangular parallelepiped shape, the approximately rectangular parallelepiped shape should not be construed as limiting the shape of the cover 20. Any other polyhedron is possible. The surfaces of the polyhedron may include a curved surface. For example, as shown in FIG. 5, the upper surface 22*a* may be curved into three surfaces shown in FIG. 3, namely, the side surface 22*b*, the upper surface 22*a*, and the side surface 22*d*. Thus, the side surface 22*b*, the upper surface 22*a*, and the side surface 22*d* may together form one surface 22*g* in a semicylindrical shape. In this case, the thickness of the coupling member 32 may be adjusted in accordance with the curved surface 22*g*, or the coupling member 32 may have a curved surface in accordance with the curved surface 22*g*. The take-out port 70 may be formed to correspond to the shape of the coupling member 32. The upper surface 22*a* of the cover 20 may be caught and connected between the coupling member 32 and the take-out port 70. The intermediate layer 40 may be disposed, for example, only at a portion corresponding to the surface 22*g*. Thus, the intermediate layer 40 is not necessarily disposed on the entire surface of the cover 20. The cover 20 may also have an approximately octahedron shape, in which case the side surface 22*b* and the side surface 22*d* shown in FIG. 3, for example, each have two surfaces.

As shown in FIG. 1, the edge lines 24*ab*, 24*ac*, 24*ad*, and 24*ae* enclose the upper surface 22*a* of the cover 20. Among the edge lines 24*ab*, 24*ac*, 24*ad*, and 24*ae*, the edge lines 24*ab* and 24*ad* are smooth, while the edge lines 24*ac* and 24*ae* are angular. Thus, some of the edge lines, namely, the edge lines 22*ab* and 22*ad* may be smooth. As shown in FIG. 1, the edge lines 24*ac*, 24*ae*, 24*bc* (see FIG. 3), 24*cd*, 24*ae*, and 24*be*, which enclose the side surfaces 22*c* and 22*e*, are angular. This improves stability at the time when the cover 20 is upright with the side surface 22*c* or 22*e* on the bottom. That is, the web container 10 is easy to use even when the opening 26 of the cover 20 faces in the lateral direction.

Figure 6:
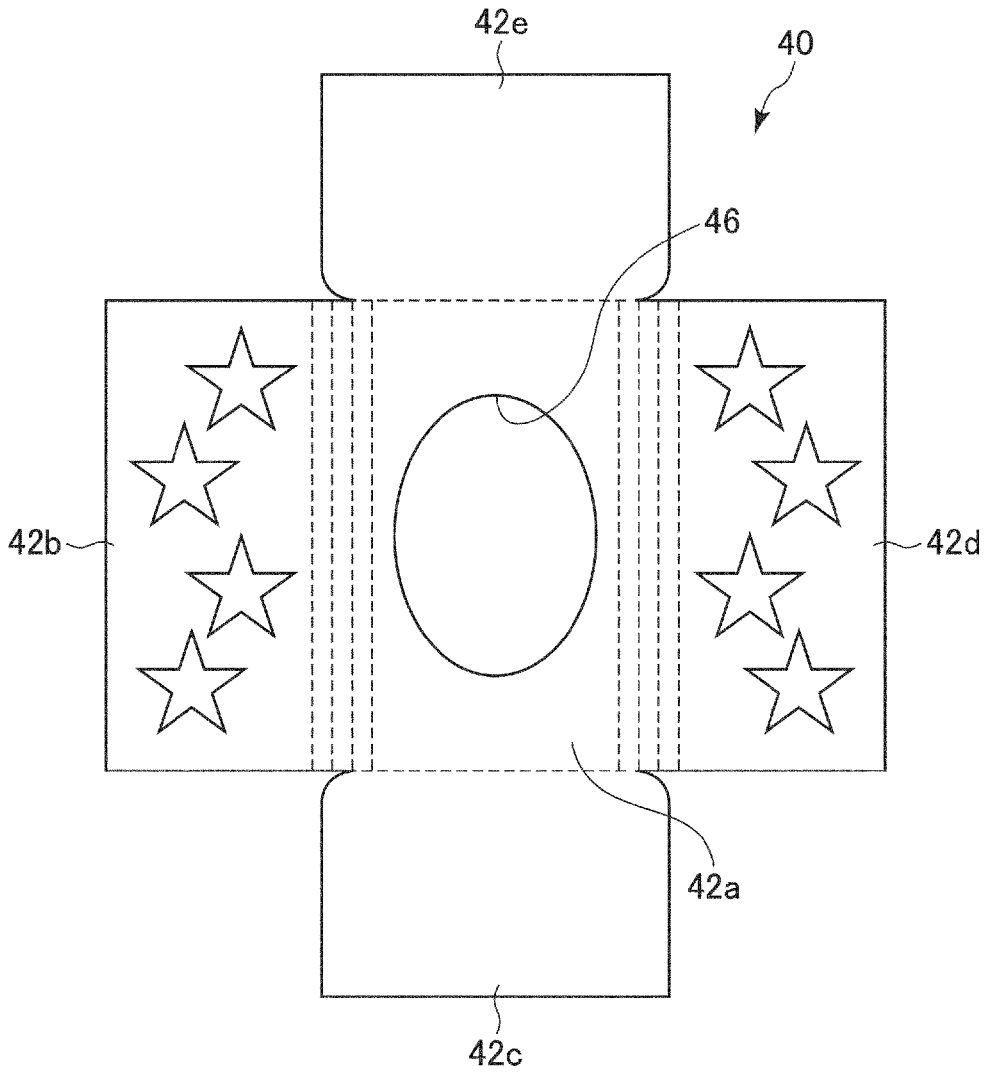
FIG. 6 is a development view of an intermediate layer.

Next, the intermediate layer 40 will be described by referring to FIG. 6. FIG. 6 is a development view of the intermediate layer 40 before being disposed in the cover 20. The dashed lines indicate portions to be bent at the time when the intermediate layer 40 is placed in the cover 20. The intermediate layer 40 has a planar shape. It is noted that the intermediate layer 40 is planar before the intermediate layer 40 is placed in the cover 20, and that the planar shape encompasses a material that can be rolled and takes on a three-dimensional shape when the material is placed in the cover 20. The material may be printed on the transparent plastic films such as non-stretched polypropylene (CPP), polyethylene (PE), and polyethylene terephthalate (PET), or may be printed on paper. Thus, there is no limitation to the material. For example, a transparent plastic film whose thickness approximately ranges from 0.05 to 0.2 mm is possible. When the material is printed on the transparent plastic film, a design may be printed on the top surface side or the back surface side of the cover 20. In FIG. 6, the design is drawn as star symbols.

The intermediate layer 40 is made up of one planar sheet, and includes portions 42*b*, 42*c*, 42*d*, and 42*e* respectively corresponding to the four side surfaces 22*b*, 22*c*, 22*d*, and 22*e*. The portions 42*b*, 42*c*, 42*d*, and 42*e* are in the periphery of a portion 42*a* corresponding to the upper surface 22*a* of the cover 20. For the webs 80 to be taken out of the web storage 60, an opening 46 is formed at a portion corresponding to the opening 26 of the cover 20. The opening 46 may be larger or the same size as the opening 26 of the cover 20. Still, making the opening 46 larger than the opening 26 ensures that the intermediate layer 40 is not caught between the cover 20 and the take-out port 70. While in the web container 10 shown in FIG. 1 the intermediate layer along the side surface 22*c* of the cover 20 is omitted, the intermediate layer 40 shown in FIG. 6 has a shape suitable for the cover 20 shown in FIG. 1. Specifically, bending between the portion 42*a*, which corresponds to the upper surface 22*a* of the cover 20, and the portions 42*b* and 42*d*, which correspond to the two side surfaces 22*b* and 22*d*, is with a large radius of curvature in accordance with the smooth edge lines 42*ab* and 42*ad*. The plurality of dashed lines indicate the portions to be bent. At portions 42*c* and 42*e*, which correspond to the two side surfaces 22*c* and 22*e*, the outer edges corresponding to the edge lines 42*ab* and 42*ad* have curved shapes that correspond to the large radius of curvature. The sections between the portion 42*a* and the portion 42*c* and between the 42*a* and 42*e* are easily bent along the angular edge lines 24*ac* and 24*ae*. The intermediate layer 40 shown in FIG. 6 can be disposed on the five surfaces of the cover 20 shown in FIG. 1 without a gap.

Figure 7:
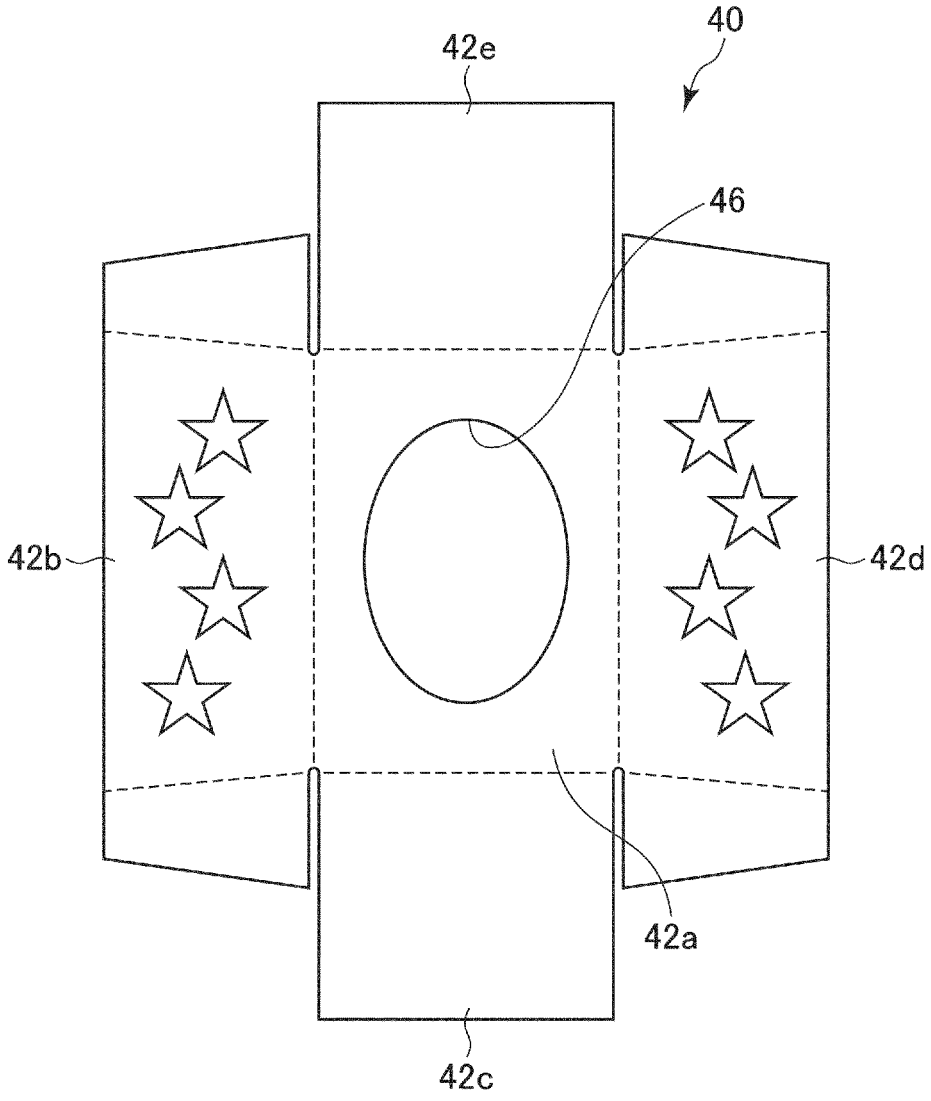
FIG. 7 is a development view of another intermediate layer different from the intermediate layer shown in FIG. 6.

FIG. 7 is a development view of the intermediate layer 40 before being disposed in a cover 20 similar to the cover in which the intermediate layer 40 shown in FIG. 6 is to be placed. In FIG. 7, a design is drawn as star symbols. The intermediate layer 40 has a shape suitable for the web container 10 shown in FIG. 2. At the portions 42*b* and 42*d* of the intermediate layer 40 respectively corresponding to the side surfaces 22*b* and 22*d*, projected portions overlapping with the portions 42*c* and 42*e* are provided. The projected portions prevent formation of a gap in the intermediate layer 40 when the intermediate layer 40 is placed in the cover 20. The projected portions may be provided anywhere else, or no projected portion may be provided.

The intermediate layer 40 is not limited to the embodiments shown in FIGS. 6 and 7, and may be formed in accordance with the shape of the cover 20. The intermediate layer 40 may be made up of a combination of two or more intermediate layer portions. Still, in the case of the web container 10 shown in FIG. 1, the shape shown in FIG. 6 is preferably formed, while in the case of the web container 10 shown in FIG. 2, the shape shown in FIG. 7 is preferably formed. This facilitates the arrangement of the intermediate layer 40 at a predetermined position in the cover 20. Specifically, after the intermediate layer 40 is disposed at a lower portion where the surface of the cover 20 is not formed, the web storage 60 is put into the cover 20 as if to cram the intermediate layer 40 into the cover 20. The intermediate layer 40 is caught between the cover 20 and the web storage 60, and thus is arranged at a predetermined position. The intermediate layer 40 may be adhered to the cover 20 or to the web storage 60. It is also possible to catch the intermediate layer 40 between the take-out port 70 and the coupling member 32 or between the take-out port 70 and the cover 20, so as to arrange the intermediate layer 40 at a predetermined position. In the web container 10 shown in FIG. 1, the intermediate layer does not include the portions 42*c* and 42*e* of the intermediate layer 40 shown in FIG. 6. That is, the intermediate layer 40 is not disposed on the inner side of the side surfaces 22*c* and 22*e*. Even in this case, only an esthetically attractive surface can be seen when the web container 10 is viewed from a direction above the opening 26 (from the upper portion of FIG. 1), through which the webs 80 are taken out. Further, the intermediate layer 40 is formed of one rectangular sheet, and this facilitates production of the web container 10.

Figure 8A:
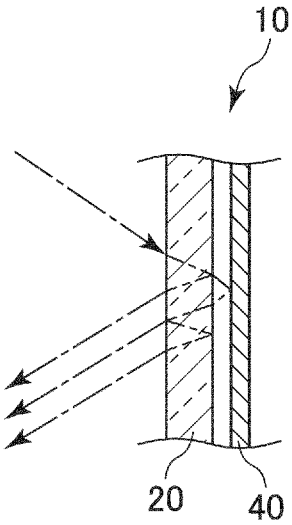
FIGS. 8A and 8B are partial cross-sectional views of the web container, illustrating its external appearance, where
Figure 8B:
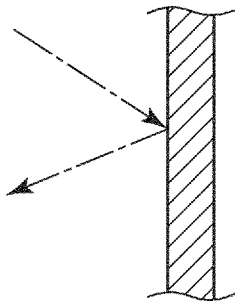
FIG.8B BACKGROUND ART

Next, the external appearance of the web container 10 will be described by referring to FIGS. 8A and 8B. FIGS. 8A and 8B are partial cross-sectional views of the web container 10, illustrating its external appearance. FIG. 8A illustrates a reflection state of light in a case where the web container 10 of the embodiment is exposed to the light. FIG. 8B illustrates a reflection state of light in a case where a conventional web container is exposed to the light. In FIG. 8A, for the clarity of the drawing, there is a large gap between the cover 20 and the intermediate layer 40. No gap may be provided or a smaller gap may be provided between the cover 20 and the intermediate layer 40. Regarding the conventional web container shown in FIG. 8B, when the surface of the conventional web container is exposed to light, reflected light is merely observed on the surface. In contrast, in the web container 10 of the embodiment shown in FIG. 8A, the cover 20 is transparent and thus the light enters the cover 20. Part of the light that enters through the inner wall of the cover 20 is reflected on the back surface of the cover 20, and the rest of the light penetrates the cover 20. The light that has penetrated the cover 20 is reflected on the intermediate layer 40. The light reflected on the intermediate layer 40 penetrates the cover 20, or is repeatedly reflected and finally penetrates the cover 20. In the web container 10, the light reflected on the intermediate layer 40 is repeatedly reflected on both front and back surfaces of the cover 20. Various kinds of reflected on various surfaces are mixed together into an image gentle for an observer, providing an esthetically attractive appearance. As a result, the web container 10 is superior in external appearance.

When the intermediate layer 40 has metallic luster as with the case of a transparent film colored by aluminum vaporization, and when light is repeatedly reflected and intensified a large number of times before the reflected light reaches the observer's eyes, then the intermediate layer 40 provides gentle, beautiful luster. As a result, the web container 10 is superior in external appearance in esthetic attraction.

Figure 9:
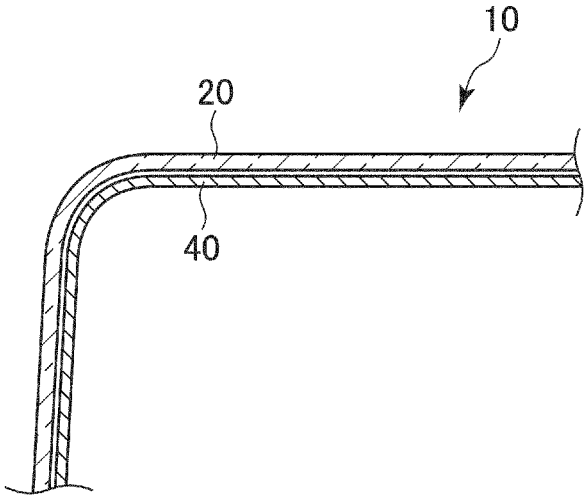
FIG. 9 is a partial cross-sectional view of the web container, illustrating the intermediate layer disposed over two surfaces of the cover.

As shown in FIG. 9, the intermediate layer 40 is disposed over at least two adjacent surfaces of the cover 20, and this ensures that an image gentle for observers is provided at the edge lines of the two surfaces. When the edge lines are smooth, the intermediate layer 40 is easily disposed along the edge lines. This is also preferable in that creases are less likely to occur on the intermediate layer 40.

When the intermediate layer 40 is pressed against the cover 20 with strong force and adhered closely to the cover 20, light reflectivity changes at the adhered part. In this case, the adhered part looks different from the periphery, which is not preferable. Moreover, when liquid is attached between the cover 20 and the intermediate layer 40, reflectivity changes only at the adhered part. This influences the external appearance, which is not preferable.

When the thickness of the transparent cover 20 changes, the three-dimensional view of the intermediate layer 40 looks more intricately due to a lens effect. For example, it is preferable that the inner surface of the cover 20 (the side on which the intermediate layer 40 is disposed) be a corrugated or rough surface.

With the conventional web container, the entire container needs to be subjected to aluminum vaporization in order to obtain metallic luster, and this necessitates a large vaporization apparatus, involving huge cost. In contrast, with the web container 10 of the embodiment, only the flat intermediate layer 40 needs to be subjected to aluminum vaporization. This realizes a substantial reduction in cost. The external appearance of the web container 10 or of a web product including the web container can be changed merely by replacing the intermediate layers 40, which is practically useful.

When the coupling member 32 is mounted on the cover 20, a large amount of force involved in the opening/closing of the lid 34 does not locally act upon the cover 20. This makes the cover 20 thinner than the coupling member 32. For example, the thickness of the cover 20 may range from 0.2 mm to 2.0 mm, preferably, from 0.3 mm to 1.0 mm. This, as a result, reduces the production cost of the cover 20 and reduces the weight of the web container 10.

The web container 10 of the embodiment excels in external appearance and is easy to produce at lower cost. Thus, the web container 10 finds applications in disposable goods. The opening through which the intermediate layer 40 or the web storage 60 is inserted may be covered with a sheet-shaped tape or similar material. By covering the opening through which the intermediate layer 40 or the web storage 60 is inserted, an object is prevented from hitting the web storage 60 and damaging the bag 62. Alternatively, the opening through which the intermediate layer 40 or the web storage 60 is inserted may be left open.

In the embodiment, the intermediate layer is visible through the cover made of a transparent plastic member, which provides an esthetically attractive external appearance. The intermediate layer is disposed over at least the two surfaces of the cover, and this makes the intermediate layer visible through the cover made of a transparent plastic member at the edge line of the surfaces, which provides an excellent external appearance. Furthermore, the web container is easily produced.

In the web container according to the embodiment, the polyhedron shape may be an approximately rectangular parallelopiped shape as shown in FIG. 1, and the intermediate layer 40 may be disposed over three continuous surfaces 22*b*, 22*a*, and 22*d* of the cover 20. The approximately rectangular parallelopiped shape may be a hexahedral shape in general. The edge line defined between the adjacent surfaces may smoothly be formed. Also the adjacent surfaces need not be orthogonal to each other. For example, as shown in FIG. 1, the approximately rectangular parallelopiped shape encompasses a shape that widens toward the bottom surface (downward direction in the figure). Further, the approximately rectangular parallelopiped shape encompasses such a shape that the cover 20 lacks one surface.

With this configuration, the intermediate layer is visible through the three continuous surfaces of the cover 20 made up of a transparent plastic member, which provides a more superior external appearance. The approximately rectangular parallelopiped shape leads to a web container that is easy to carry around and easily stored in a box. Further, the web storage having the approximately rectangular parallelopiped shape is easily stored.

In the web container according to the embodiment, the intermediate layer 40 may be disposed on the upper surface

22*a*, on which the opening 26 of the cover 20 is formed and on two opposite side surfaces 22*b* and 22*d*, which are adjacent to the upper surface 22*a*, as shown in FIG. 1.

With this configuration, when the web container is viewed on the opening in order to take out the web, the intermediate layer is visible through the cover made of a transparent plastic member on the front surface and both side surfaces. This ensures a web container that is superior in external appearance.

In the web container according to the embodiment, the edge line 24*ab* defined between the two surfaces 22*a* and 22*b* of the cover 20, over which the intermediate layer 40 is disposed, is smooth without a sharp portion, as shown in FIG. 1.

With this configuration, since the edge line is not angular, the intermediate layer is visible from the outside at the edge line. This ensures a web container that is superior in external appearance.

In the web container of the embodiment, the intermediate layer between the web storage and the cover made of a transparent plastic member is disposed over at least the two adjacent surfaces of the cover. This ensures such an excellent external appearance that the intermediate layer is visible through the cover made of a transparent plastic member. The intermediate layer is disposed over at least two surfaces of the cover. This makes the intermediate layer visible through the cover made of a transparent plastic member at the edge line of the two surfaces, and provides a superior external appearance. Moreover, the web container is easily produced. A further advantageous effect is that it is not necessary to print merchandise information on the cover or the bag having a complicated shape; any design or information may be printed on the intermediate layer. This ensures production of web containers of various designs. Once un-printed web containers or un-printed covers are manufactured, the design on the intermediate layer can easily be changed. This facilitates change of the design.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A web container comprising:

a web storage comprising:

a bag to store a foldable web and comprising a first opening through which the foldable web is to be taken out; and a take-out port coupled to the first opening;

a transparent plastic cover having a polyhedron shape to enclose the web storage, the transparent plastic cover including a second opening provided on one surface of the transparent plastic cover, the second opening being engaged with the take-out port; and an intermediate layer comprising a sheet provided between the cover and the web storage and having portions over at least two adjacent surfaces of the transparent plastic cover.

2. The web container according to claim 1, wherein the polyhedron shape of the transparent plastic cover comprises an approximately rectangular parallelopiped shape, and wherein the intermediate layer is disposed over three continuous surfaces of the transparent plastic cover.

3. The web container according to claim 2, wherein the second opening is disposed on an upper surface of the transparent plastic cover, and the intermediate layer is disposed on the upper surface and on two opposite side surfaces of the transparent plastic cover that are adjacent to the upper surface.

4. The web container according to claim 1, wherein a smooth edge line without a sharp portion is defined between the at least two adjacent surfaces of the transparent plastic cover.

5. The web container according to claim 2, wherein a smooth edge line without a sharp portion is defined between the at least two adjacent surfaces of the transparent plastic cover.

6. The web container according to claim 3, wherein a smooth edge line without a sharp portion is defined between the at least two adjacent surfaces of the transparent plastic cover.

* * * * *